US006564969B1

(12) United States Patent
Loy

(10) Patent No.: US 6,564,969 B1
(45) Date of Patent: May 20, 2003

(54) PERSONAL DEFENSE APPARATUS

(76) Inventor: Roberta Loy, 15337 West Domingo La., Sun City West, AZ (US) 85375

( * ) Notice: Subject to any disclaimer, the term of this patent is extended or adjusted under 35 U.S.C. 154(b) by 0 days.

(21) Appl. No.: 09/908,332

(22) Filed: Jul. 18, 2001

Related U.S. Application Data

(60) Provisional application No. 60/221,194, filed on Jul. 27, 2000.

(51) Int. Cl.[7] ..... B67D 17/04
(52) U.S. Cl. ..... 222/78; 222/175
(58) Field of Search ..... 222/78, 175

(56) References Cited

U.S. PATENT DOCUMENTS 3,777,336 A * 12/1973 Anderson ..... 24/113 MP
4,061,249 A * 12/1977 Smith ..... 222/78
4,135,645 A * 1/1979 Kimmell ..... 222/78
4,793,155 A * 12/1988 Law ..... 63/40
5,316,182 A * 5/1994 Lee et al. ..... 222/78
5,379,928 A * 1/1995 Mikkelsen ..... 224/257

* cited by examiner

*Primary Examiner*—Gene Mancene
*Assistant Examiner*—Melvin A. Cartagena
(74) *Attorney, Agent, or Firm*—Parsons & Goltry; Robert A. Parsons; Michael W. Goltry

(57) ABSTRACT

Personal defense apparatus including a receptacle containing a quantity of a defensive composition, an attached nozzle for directing a flow of the defensive composition from the receptacle through an opening, and attached ornamentation disguising the receptacle and the nozzle and that does not interfere with the flow of the defensive composition from the receptacle through the nozzle.

12 Claims, 2 Drawing Sheets

PERSONAL DEFENSE APPARATUS

CROSS-REFERENCE TO RELATED APPLICATIONS

This application claims the benefit of Provisional Application Ser. No. 60/221,194, filed Jul. 27, 2000.

FIELD OF THE INVENTION

This invention relates to dispensers of defensive compositions for use in repelling attackers.

BACKGROUND OF THE INVENTION

Pepper spray and mace and other disabling or defensive compositions are highly effective for providing personal defense against attackers both human and animal. Defensive compositions are packaged in relatively small spray dispensers that people usually carry in purses or pockets. Some defensive spray dispensers are designed to attach to key chains. However, defensive spray dispensers are usually always kept concealed in purses and pockets. Concealing a defensive spray dispenser in a purse or pocket makes it very difficult to rapidly retrieve and prepare it in time to repel an attacker. In fact, most people, especially women, who are attacked and who also carry a defensive spray dispenser are usually overcome by their attacker before they have a chance to access and use the defensive spray dispenser.

Thus, what is needed is a defensive composition spray dispenser that is disposed with ornamentation so as to form an ornament that is capable of being worn as a piece of jewelry and easily accessed in the face of an oncoming attacker. The decorative features of the ornament conceal the defensive spray container and yet allow the disabling composition it contains to be easily and efficiently dispensed.

SUMMARY OF THE INVENTION

The above problems and others are at least partially solved and the above purposes and others realized in an improved apparatus including a receptacle containing a quantity of a defensive composition, an attached nozzle for directing a flow of the defensive composition from the receptacle through an opening, and attached ornamentation disguising the receptacle and the nozzle and that does not interfere with the flow of the defensive composition from the receptacle through the opening of the nozzle. The ornamentation includes an opening communicating with an opening of the nozzle. The apparatus further includes an attached necklace, which is constructed so as to be easily severed should a user need to do so in order to effectively wield the receptacle, activate the nozzle and direct a resulting flow of the defensive composition toward an aggressor. The ornamentation is attached to at least one of the nozzle and the receptacle and preferably the former. In a preferred embodiment the ornamentation is a single attached ornament. However, the ornamentation can be a plurality of attached ornaments if desired.

Consistent with the foregoing, the invention also contemplates associated methods.

BRIEF DESCRIPTION OF THE DRAWINGS

Referring to the drawings.

DETAILED DESCRIPTION OF A PREFERRED EMBODIMENT

Figure 2:
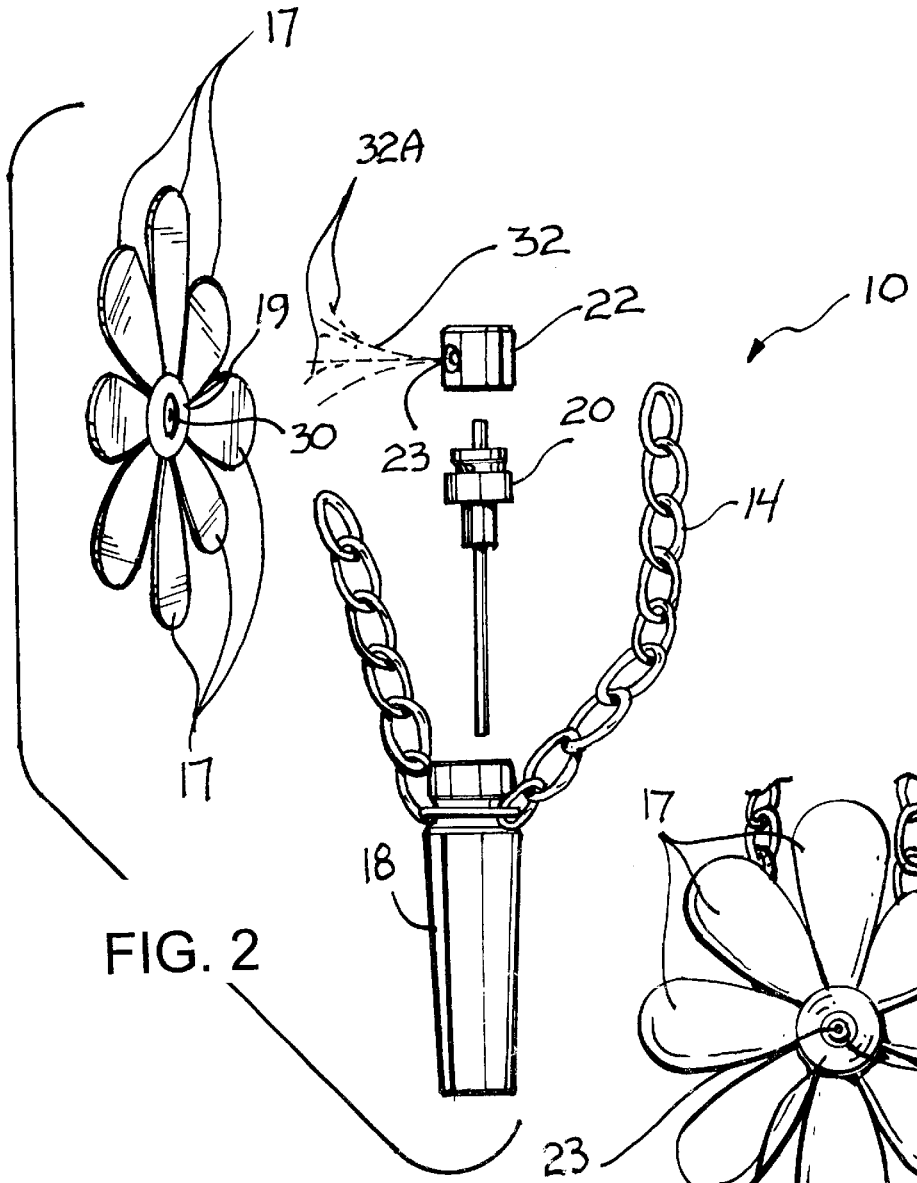
FIG. 2 is an exploded perspective view of the dispenser of FIG. 1 and illustrating portions of an attached necklace.
Figure 1:
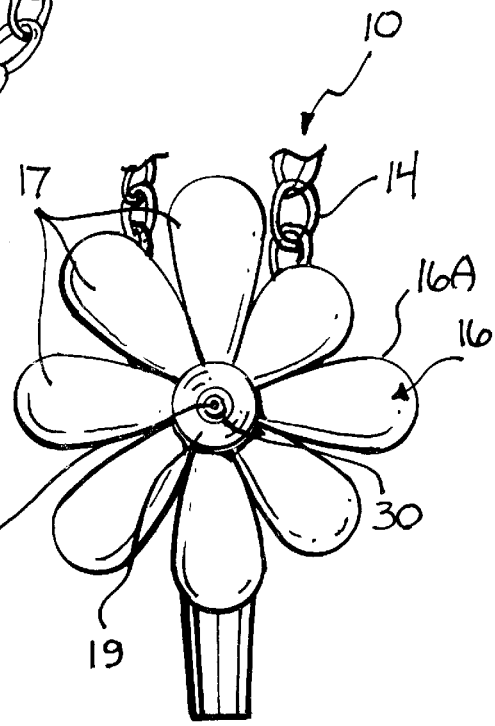
FIG. 1 is a front elevation of a defensive composition spray dispenser, in accordance with the invention.

Referring to the drawings, FIG. 1 illustrates a front elevation of a defensive composition spray dispenser generally designated at 10 and FIG. 2 illustrates an exploded perspective view of dispenser 10. Dispenser 10 includes a receptacle or canister 18 containing a quantity of a disabling or defensive composition designated at 32 in FIG. 2. Composition 32 is pepper spray or mace or other form of defensive composition for repelling and providing personal defense against attackers both human and animal. Referring to FIG. 2, a nozzle 22 is attached to an end of receptacle 18 and communicates with defensive composition 32 contained by receptacle 18. Nozzle 22 is furnished with an opening 23 for directing a flow of defensive composition 32 from receptacle 18 in the form of a spray 32A. Nozzle 22 is associated with a pump 20 assembly, which is housed by receptacle 18 and interacts with defensive composition 32 contained therein. Pump assembly 20 activates in response to a pumping force applied against nozzle 22 and pulls defensive composition 32 from receptacle 18 and ejects it outwardly through opening 23 of nozzle 22 in the form of spray 32A.

Dispenser 10 includes attached ornamentation 16 that functions to disguise receptacle 18 and nozzle 22 in a manner that prevents dispenser 10 from becoming recognized and that otherwise gives dispenser 10 the appearance of a piece of jewelry. In this embodiment, ornamentation 16 is an ornament 16A that generally represents a flower head. The attachment of ornament 16A to dispenser 10 serves to substantially conceal receptacle 18 and nozzle 22 from becoming recognized and otherwise serves to represent a flower attached to a stem or positioned in a pot, which stem or pot is actually receptacle 18. Ornament 16 includes radially disposed leaflets 17 attached to a central portion or hub 19, and is constructed of plastic or metal or other desired material or combination of materials. Hub 19 is attached to nozzle 22 with glue or welding or is integrally formed with nozzle 22, and includes an opening 30 communicating with opening 23 of nozzle 22. Defensive composition 32 dispensed from receptacle 18 through opening 23 passes also through a central opening 30 of ornament 16A. Accordingly, ornament 16A does not interfere with flow of the defensive composition 32 from receptacle 18 through nozzle 22 and does not interfere with the ejection of defensive composition 32 in the form of spray 32A as against an attacker. Ornament 16A can be attached to receptacle 18 if desired and can be attached in any way so as to not interfere with the flow of defensive composition 32 from receptacle 18 through nozzle 22 and outwardly therefrom in the form of spray 32A as against an attacker. In this spirit, an opening of ornament 16A communicating with opening 23 nozzle can be formed at other locations about the extent of hub 19 and otherwise through any one of leaflets 17 depending on the attachment of ornament 16A. Ornament 16A can also be attached in a manner so that opening 23 of nozzle 22 is unobstructed so as to not interfere with spray 32A of defensive composition 32.

Ornamentation 16 is intended to provide dispenser 10 as a piece of jewelry that is capable of being worn by a user in an exposed position so that it can be easily reduced to hand for use in directing defensive composition 32 against an oncoming attacker. Preferably, dispenser 10 is attached to a necklace 14, which can be worn around a users neck with dispenser 10 appearing as a piece of jewelry suspended thereby. When worn in this manner, dispenser 10 is readily available and easily reduced to hand for use. Preferably, necklace 14 is constructed and arranged so that it is readily severable, such that a user can rapidly reduce dispenser 10 to hand and tear it from necklace 14 so as to break or severe it so that dispenser 19 can be wielded as desired and without impediment from necklace 14 as to direct spray 32A in a most effective manner. Preferably, necklace is attached to receptacle 18 and it can be attached elsewhere such as to nozzle or to ornamentation 16.

Figure 4:
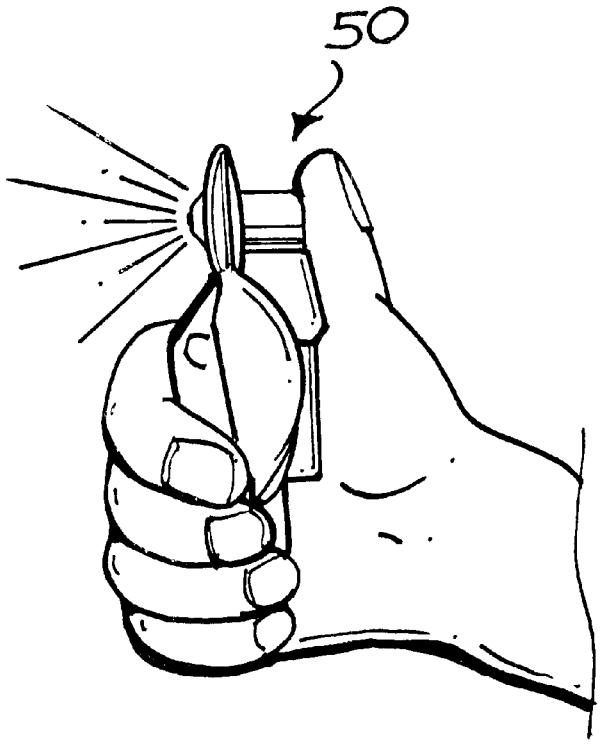
FIG. 4 is a side elevation illustrating the dispenser of FIG. 3 as it would appear held and discharging a defensive composition.
Figure 3:
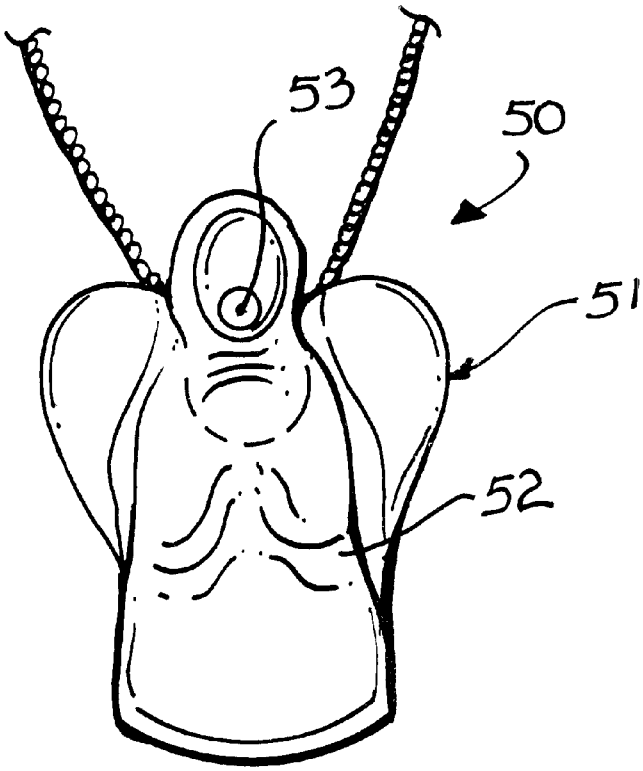
FIG. 3 is a front elevation of a defensive composition spray dispenser, in accordance with another embodiment of the invention.

Ornamentation 16 can be provided in any desired or decorative form and attached in any suitable way form so as to disguise receptacle 18 and nozzle 22 as previously discussed. In this spirit, FIG. 3 is illustrative of a defensive composition spray dispenser 50 that is common to dispenser 10 in structure and function, and that incorporates ornamentation 51 that is an angelic ornament 52. Ornament 52 includes an opening 53 that is formed through the head of the ornament 52 communicating with the opening of the nozzle in a manner consistent with that of dispenser 10. Opening 53 can be formed elsewhere. FIG. 4 is illustrative of dispenser 50 as it would appear reduced to hand and employed in dispensing a spray of defensive composition.

The present invention is described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus comprising:

a receptacle containing a quantity of a defensive composition;

an attached nozzle and pump assembly, the nozzle having an opening for directing a flow of the defensive composition from the receptacle;

ornamentation separate and distinct from the receptacle, pump assembly and nozzle, the ornamentation removably attached to the nozzle, whereby the receptacle and the nozzle are entirely hidden behind the ornamentation and removable therefrom for replacement; and an opening of the attached ornamentation communicating with the opening of the nozzle.

2. Apparatus of claim 1, further including an attached necklace.

3. Apparatus of claim 2, wherein the necklace is readily severable.

4. Apparatus of claim 1, wherein the ornamentation is attached to the nozzle.

5. Apparatus of claim 1, wherein the ornamentation is attached to the receptacle.

6. Apparatus of claim 1, wherein the attached ornamentation comprises at least one attached ornament.

7. Apparatus comprising:

a receptacle containing a quantity of a defensive composition, and a dispensing apparatus;

a nozzle attached to the dispensing apparatus for directing a flow of the defensive composition from the receptacle through an opening;

ornamentation separate and distinct from the receptacle, dispensing apparatus and nozzle, the ornamentation removably attached to the nozzle, whereby the receptacle, the dispensing apparatus and the nozzle are entirely hidden behind the ornamentation that does not interfere with the flow of the defensive composition from the receptacle through the nozzle; and a necklace attached to the ornamentation.

8. Apparatus of claim 7, wherein the ornamentation includes an opening communicating with an opening of the nozzle.

9. Apparatus of claim 7, wherein the necklace is readily severable.

10. Apparatus of claim 7, wherein the ornamentation is attached to the nozzle.

11. Apparatus of claim 7, wherein the ornamentation is attached to the receptacle.

12. Apparatus of claim 7, wherein the attached ornamentation comprises at least one attached ornament.

* * * * *